United States Patent [19]

Ikehata et al.

[11] Patent Number: 4,975,673

[45] Date of Patent: Dec. 4, 1990

[54] CIRCUIT BREAKER APPARATUS INCLUDING TRIP DISPLAY MECHANISM

[75] Inventors: Yoji Ikehata; Tadayoshi Onoda; Kenichi Takahashi, all of Hiroshima, Japan

[73] Assignee: Mitsubishi Denki Kabushiki Kaisha, Tokyo, Japan

[21] Appl. No.: 217,289

[22] Filed: Jul. 11, 1988

[30] Foreign Application Priority Data

Jul. 13, 1987 [JP] Japan ..... 62-107931

[51] Int. Cl.[5] ..... H01H 71/04; H01H 13/12

[52] U.S. Cl. ..... 337/79; 335/17; 335/76

[58] Field of Search ..... 200/17 R, 50 AA, 308, 200/DIG. 42, 400 MS File, 50 A; 335/76, 68, 69, 17, 69; 337/1, 12, 79

[56] References Cited

U.S. PATENT DOCUMENTS 3,227,831 1/1966 Jacks et al. ..... 200/50 A 3,296,565 1/1967 Kiesel et al. ..... 335/69

4,644,122 2/1987 Farley et al. ..... 200/380 X

*Primary Examiner*—J. R. Scott

*Attorney, Agent, or Firm*—Burns, Doane, Swecker & Mathis

[57] ABSTRACT

An apparatus for electrically operating a circuit breaker comprising a trip display mechanism for displaying trip condition of the circuit breaker while the circuit breaker is in trip state thereof. The trip display mechanism comprises an elongate trip detecting plate which is supported pivotally at intermediate point thereof on a slider and engages at its one tip end with the handle of the circuit breaker which causes the trip detecting plate to pivot during the trip condition; and an elongate trip display plate having an indicia indicative of the trip condition of the circuit breaker at one end thereof, the display plate being swingably supported at intermediate point thereof on a frame and engaging with the other end of the trip detecting plate, the trip display plate being caused by the trip detecting plate to swing to a position where the indicia appears on a display window during the trip condition of the circuit breaker.

4 Claims, 13 Drawing Sheets

3
5
11
19
21
18
17
14
C
23
20
A
12b
12a
15
16
1
13b
13a
13
2
12

PRIOR ART

CIRCUIT BREAKER APPARATUS INCLUDING TRIP DISPLAY MECHANISM

BACKGROUND OF THE INVENTION

1. Field of the Invention

The present invention relates to an apparatus for electrically operating a circuit breaker in which a spring is compressed by means of an electric motor to store mechanical energy and then the mechanical energy is discharged to throw the circuit breaker.

2. Description of the Prior Art

One such a conventional apparatus for electrically operating a circuit breaker will be described with reference to FIG. 13 to FIG. 16. FIG. 13 is a side view of the apparatus in which the spring has fully discharged mechanical energy thereof; FIG. 14 is a cross sectional side view of the apparatus in which the spring is being compressed; FIG. 15 is a cross sectional side view of the apparatus in which the spring has been fully compressed; and FIG. 16 is a general top view of FIG. 15.

Referring to the diagrams, a frame 3 of a prior art apparatus is secured to the front portion of a circuit breaker 1. An electric motor 4 is secured on the frame 3 and the rotation of the motor 4 is transmitted to a main shaft 6 which drives a ratchet gear 5 via a reduction gear 8. The main shaft 6 is connected to the motor via a one way clutch 7. The ratchet gear 5 is provided with a cam 11, which rotates together with the ratchet 5 in a unitary motion. The cam 11 engages a roller 17 which is journaled for free rotation on a side wall **12*b* of a slider 12 for causing the slider 12 to slide on a guide rod 14 which is secured to the frame 3. The guide rod 14 extends through a rod insertion hole 15 provided on a front wall 12*a* of the slider 12**.

Thus the slider 12 is guided by the guide rod 14 to slide thereon. A spring 16 is attached to the guide rod 14. The slider 12 is provided with two handle drive pins **13*a* and 13*b* to drive a handle 2 of the circuit breaker 1 therebetween, the drive pin 13*a* for throwing the handle 2 into the ON position and the drive pin 13*b* for throwing the handle 2 into the OFF position. When an OFF signal is supplied, the motor 4 drives the main shaft 6 in rotation via the ruduction gear 8 and the one way clutch 7; thereby causing the ratchet gear 5 to rotate in a direction of an arrow A in FIG. 13. The cam 11 also rotates with the ratchet gear 5 in the direction A, then comes in contact with the roller 17 for causing the slider 12 to slide in a direction of an arrow B. At this time the slider 12 compresses the spring 16 as shown in FIG. 14, while also throwing the handle 2 into the OFF-position of the circuit breaker 1 by means of the handle drive pin 13*b*. A stop lever 19 is swingably mounted on the side wall 12*b* of the slider 12. The side wall 12*b* is provided with a guide and stopper pin 23 to engage with an elongate hole of the stop lever 19. The stop lever 19 is urged against the side wall 12*b* by means of a twist spring 20. The stopper pin 21 of the cam 11 engages with a bent portion of the stop lever 19 for causing the stop lever 19 to swing against the twist spring 20. Moving in the direction B, the slider 12 approaches a position where the circuit breaker 1 becomes OFF, and then the stop lever 19 engages with an actuating lever of a limit switch 18. When the ratchet gear 5 further rotates, the cam 11 causes the stop lever 19 to swing in a direction of an arrow C against the twist spring 20. In this manner, the stop lever 19 actuates the limit switch 18 to stop the motor 4. The stopper pin 23 terminates swinging motion of the stop lever 19 in a condition shown in FIG. 15. Thus overrun of the cam 11 is prevented. The slider 12 is held by a latch mechanism 22 at a position shown in FIG. 15. The latch mechanism 22 is to hold both the slider 12 and the spring 16 at a position at which the spring 16 remains fully compressed, and is formed by a link 22*a* of the slider 12 and a latch (not shown) of the frame 3. Additionally the ratchet gear 5** is provided with a fixed pawl to prevent reverse rotation thereof.

In FIG. 16, operating a manual opration handle 9 in a pumping fashion permits rotation of the ratchet 5 in the direction A in FIG. 13 thus the off-operation of the circuit breaker can also be effected in a manner similar to the case operated by the motor 4. In the manual mode, the motor 4 is disconnected with the aid of the one way clutch 7.

The ON-operation of this conventional apparatus to make the circuit breaker ON will now be described with reference to FIG. 15 which shows the OFF state of the circuit breaker 1. When the latch 22 is actuated upon occurrence of the ON signal, the slider 12 is set free from being latched and the stored mechanical energy of the compressed spring 16 is released. The slider is then pushed out to slide in a direction of an arrow D while at the same time the stop lever 19 moves in the direction D, during which the slider 12 switches the handle 2 to the ON position by means of the handle drive pins **13*a* as shown in FIG. 13**.

With the conventional apparatus for electrically operating a circuit breaker thus far described, it is necessary to stop the motion of the cam 11 at a specific location so that the cam 11 and the roller 17 are positioned within a predetermined area after the OFF-operation is completed. For this purpose, a special type of a brake such as reverse rotation was applied to bring the motor 4 to a stop, or mechanical strength of the bent portion was increased to stop the further swing of the stop lever 19, thereby preventing overrun of the cam 11 due to inertial rotation of the electrical motor 4. Also in the case of malfunction of a limit switch 18 which operatively engages with the cam 11 to switch off the motor 4, the stopper portion of the cam 11 is damaged or the motor 4 burns out due to overload.

SUMMARY OF THE INVENTION

The present invention was made to solve the problems described above. An object of the invention is to provide a reliable apparatus for electrically operating a circuit breaker in which a trip display mechanism is provided to eliminate chance of misoperation of the apparatus by an operator.

According to the present invention, an apparatus for electrically operating a circuit breaker is provided with a trip display mechanism which is driven by a handle of the circuit breaker to display that the circuit breaker is in trip condition thereof while the handle travels a small clearance toward an ON-handle-drive-pin.

BRIEF DESCRIPTION OF THE DRAWINGS

The foregoing objects and advantages will be better understood from the following description with reference to the accompanying drawings, in which.

PREFERRED EMBODIMENT OF THE INVENTION

Figure 1:
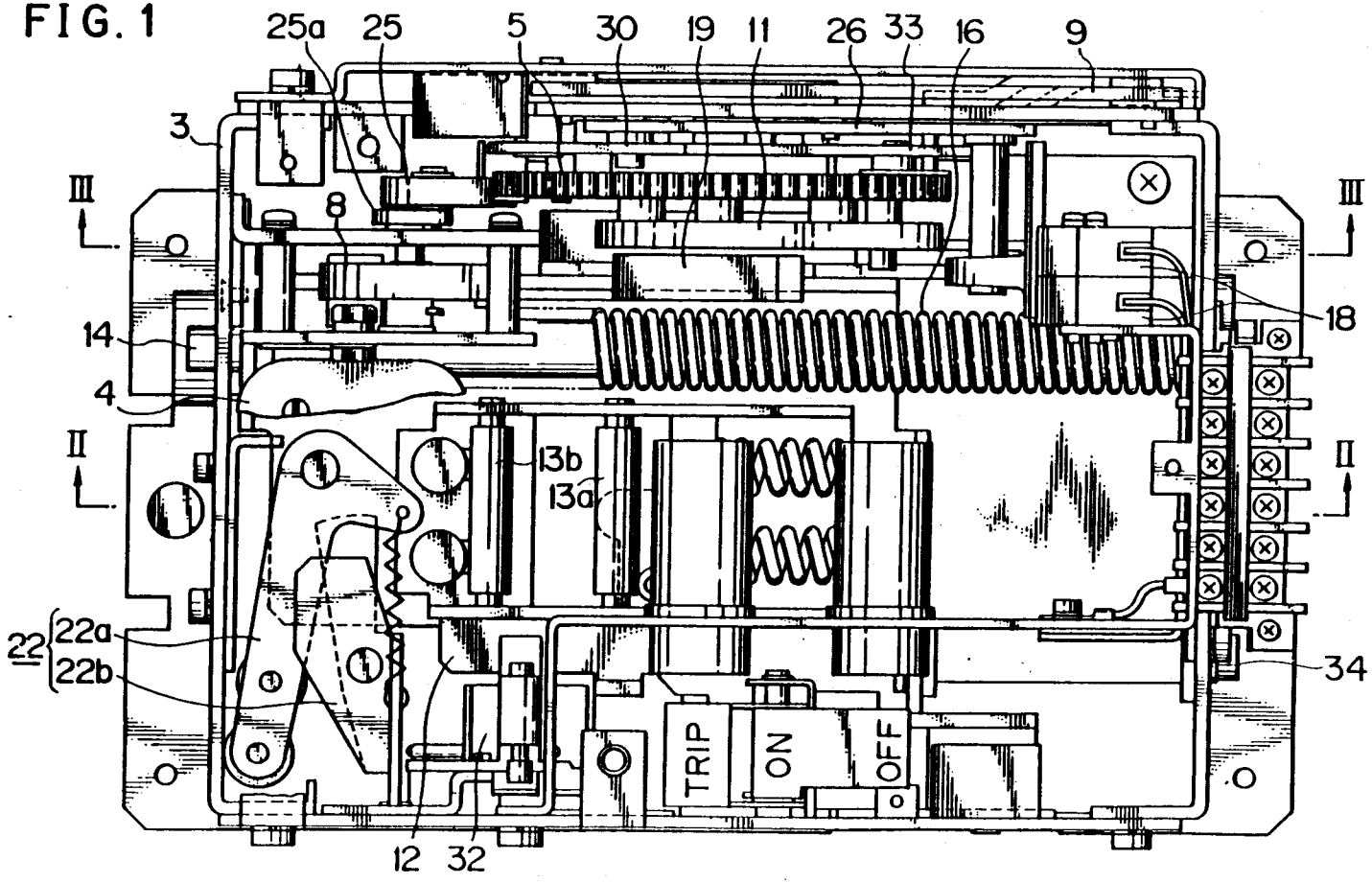
FIG. 1 is a top view depicting the inside of an apparatus according to the invention.

Elements similar to the conventional apparatus have been given similar reference numerals throughout the drawings.

A ratchet gear 5 is rotatably supported on a frame 3, and is driven in intermittent rotation by an electrically powered pawl 25, which is connected to an electric motor 4 through a reduction gear 8. The tip end of the electrically powered pawl 25 engages the gear 5 while the other end of the pawl 25 performs an eccentric motion about an eccentric shaft 25*a*. The ratchet gear 5 is provided with a cam 11 with which the ratchet 5 rotates in a unitary motion. The cam 11 engages a roller 17 which is mounted for free rotation on a side wall 12*b* of the slider 12. The cam pushes the slider 12 via the roller 17 for causing the slider 12 to slide on a guide bar 14 when the ratchet rotates. The guide bar 14 extends through a rod insertion hole 15 in the front wall 12*a* of the slider 12 is secured at both ends thereof to the frame 3 and is provided with a spring 16 thereon. A pawl 24 ensures that the ratchet gear 5 rotates in only one direction.

Figure 13:
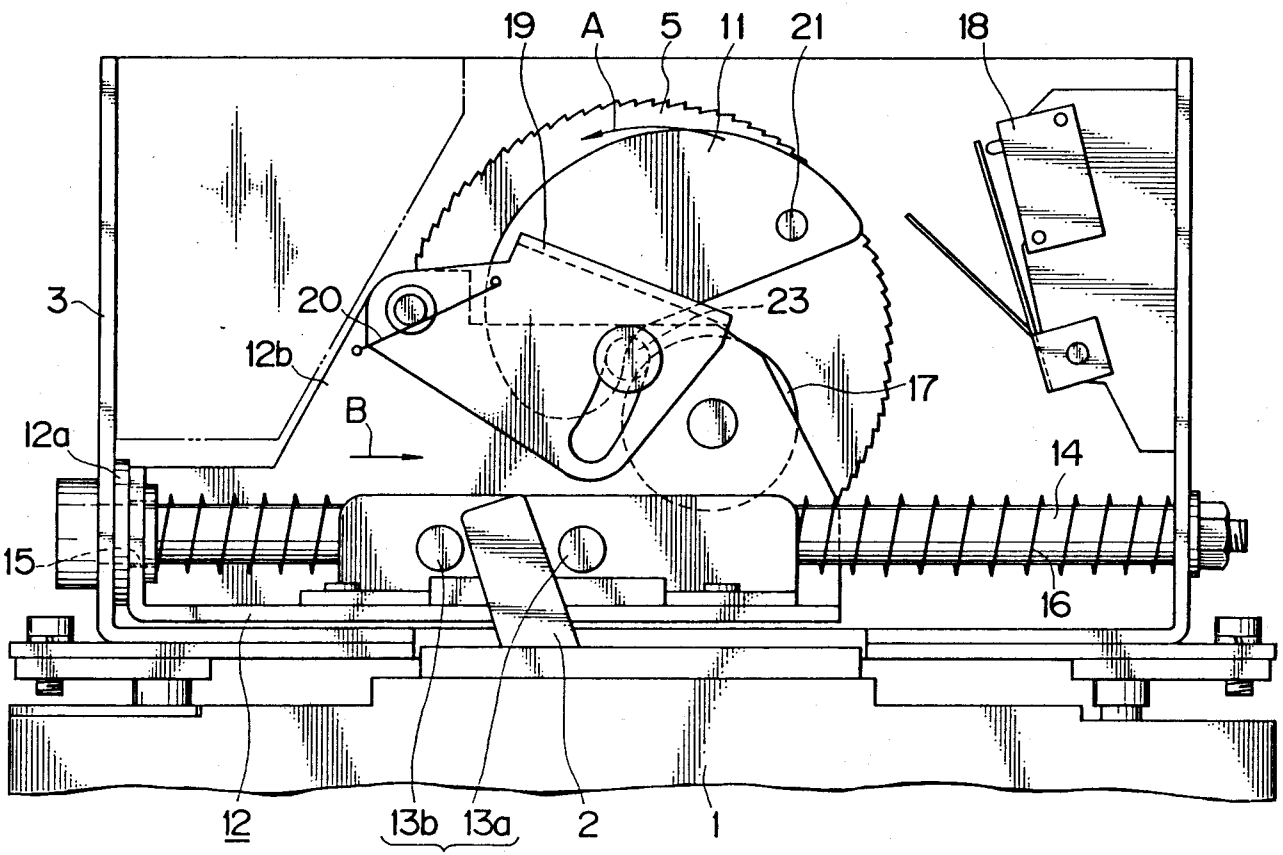
FIG. 13 is a cross sectional side view for showing the spring of the conventional apparatus which has discharged fully the stored mechanical energy.
Figure 14:
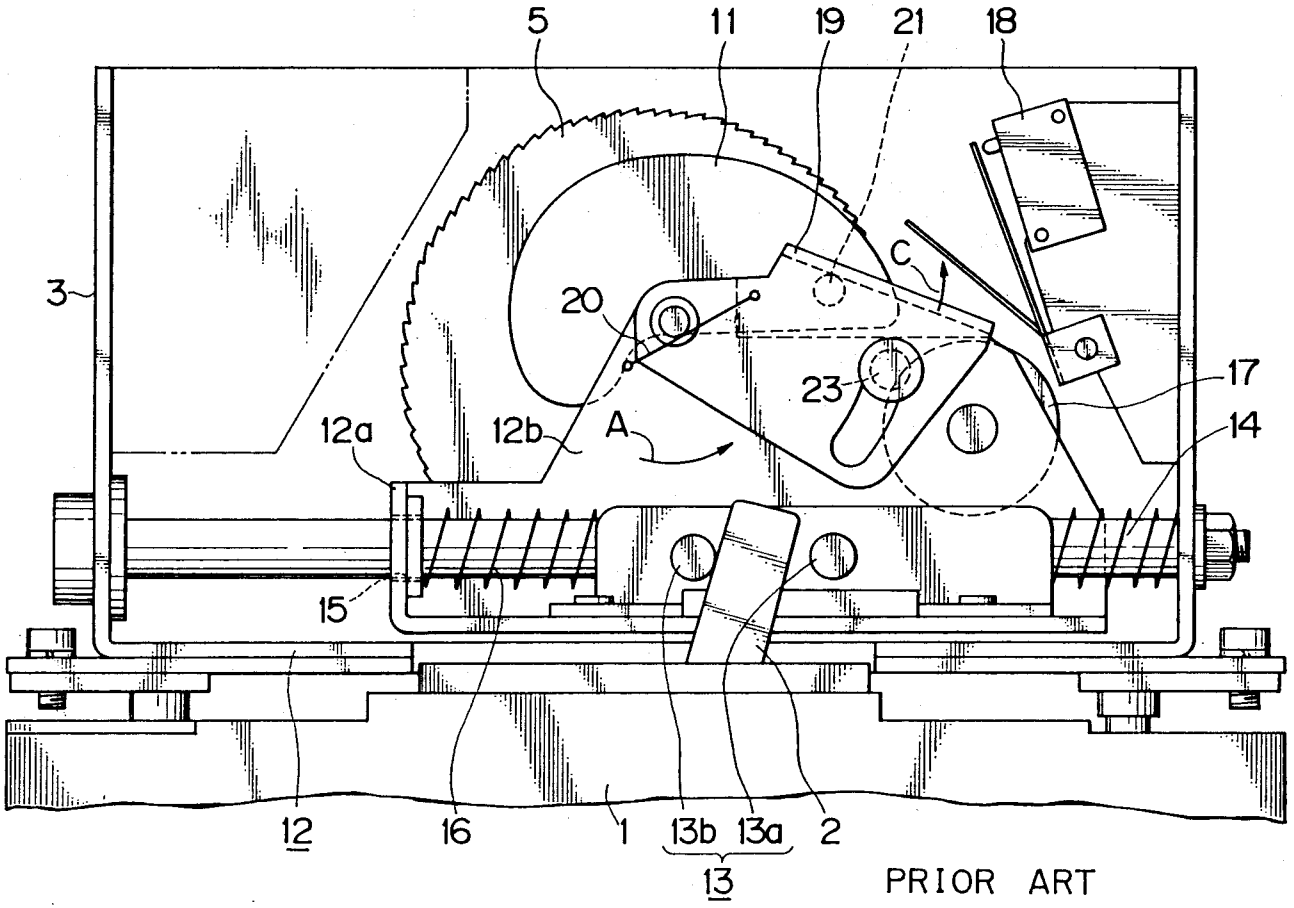
FIG. 14 PRIOR ART
FIG. 14 is a cross sectional side view for showing the spring which is being compressed.
Figure 15:
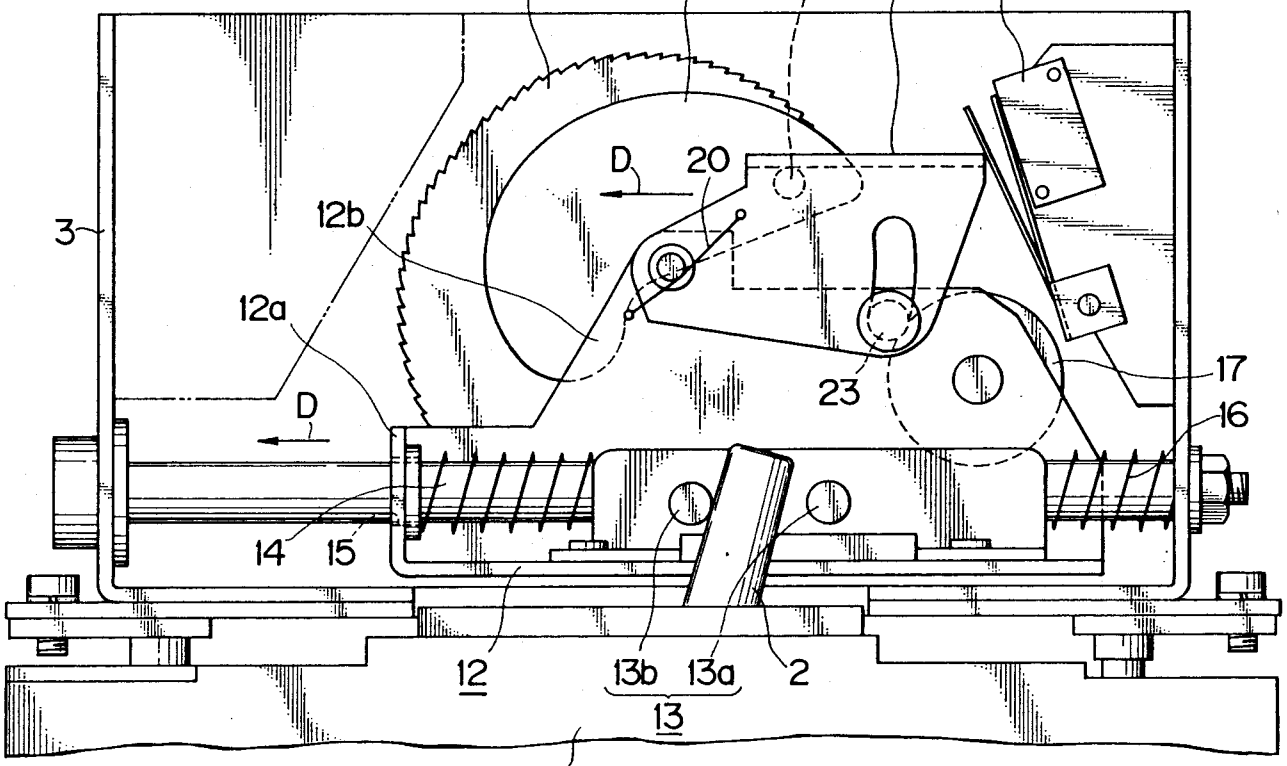
FIG. 15 PRIOR ART
FIG. 15 is a cross sectional side view for showing the spring which has been fully compressed.
Figure 16:
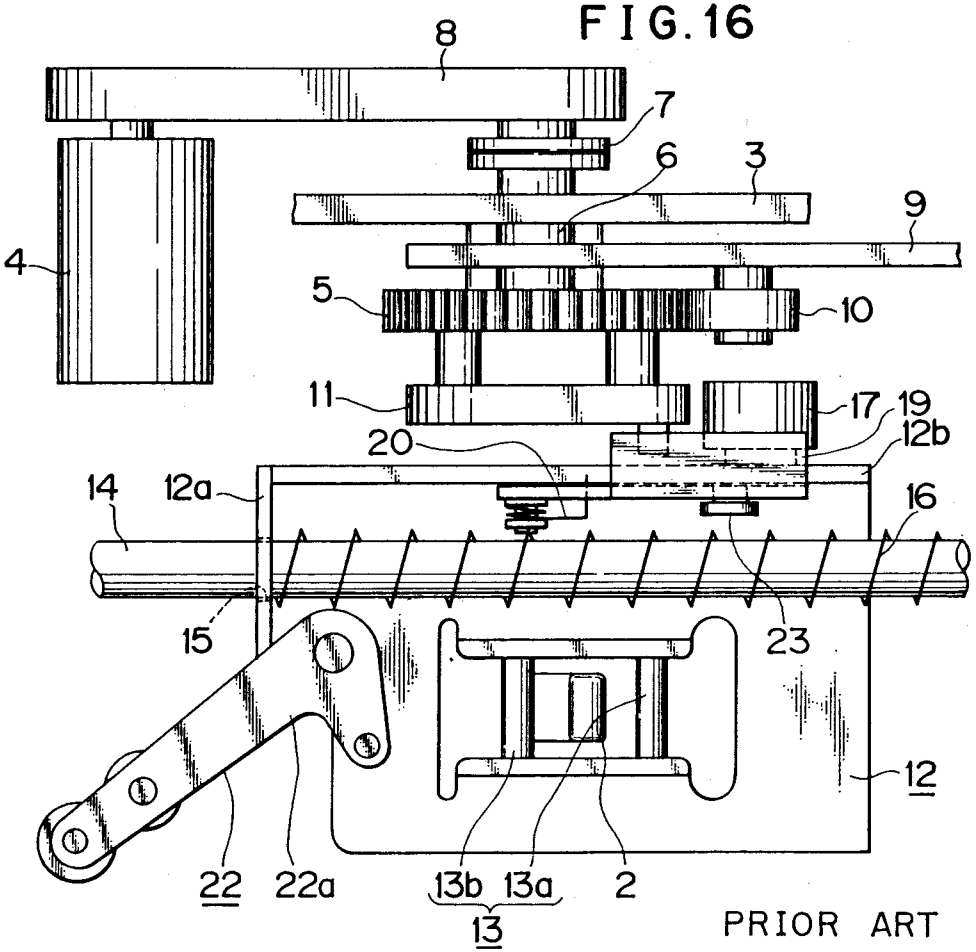
FIG. 16 is a general top view of FIG. 15.

The slider 12 is provided with two handle drive pins 13*a*, 13*b* (collectively shown as driving arrangement 13) which engage a handle 2 of a circuit breaker 1 to throw the circuit breaker 1 into the ON or OFF state thereof. A latch mechanism 22 including a latch 22*b* is to maintain the slider 12 at a position where the breaker is in the OFF state, and is operated by a solenoid coil 32. The slider 12 is provided with an insertion hole 35 at a rear side wall 12*c* through which a guide rod 34 extends. The guide rod 34 is supported at one end thereof by the frame 3 and serves to guide the slider 12. A protruding strip 39 is provided on the slider 12 and engages with or disengages from a lower portion 37*b* of an ON/OFF display plate 37 to selectively display "ON" or "OFF". The ON/OFF display plate 37 is swingably supported on the frame 3 by means of a pin 38, and has a display portion 37*a* indicative of "ON" and "OFF" at a top end thereof, which can be seen through a display window 36. The pivotal motion of the ON/OFF display plate 37 is limited by a stopper 40. A stopper pin 21 is provided on the cam 11. When the ratchet gear 5 is driven in rotation, the stopper pin 21 engages with a stop lever 19 which is pivotally mounted on the side wall 12*b* of the slider 12, thereby the stop lever 19 swinging about a pivot thereof. A twist spring 20, similar to that shown in FIG. 13 but not shown here for purposes of simplicity and clarity, urges the stop lever 19 against the side wall 12*b*. A limit switch 18 is provided on the frame 3 to switch on or off the electric circuit of the motor 4.

A trip detecting plate 41 is pivotally supported by a pin 42 on the slider 12 near the ON handle-drive-pin 13*a*. The handle 2 urges one end 41*a* of the trip detecting plate 41 against a twist spring 43 during the trip of the breaker. A trip display plate 44 is swingably supported on the frame 3 by means of the pin 38, a display portion 44*a* of which takes a position between the display 37*a* of the ON/OFF display plate 37 and the display window 36 during trip of the circuit breaker, and a lower portion 44*b* of which engages with the other end 41*b* of the trip detecting plate 41. The pivotal motion of the trip display plate 44 is limited by a stopper 45 mounted on the frame 3. A tension spring 46 is provided between the trip display plate 44 and the ON/OFF display plate 37, and urges the trip display plate 44 against the stopper 45 and the ON/OFF display plate 37 against the stopper 40.

A first release plate 26 is pivotally supported on the frame 3 by means of a first pivot pin 27. A release pin 28 is provided on the first release plate 26 to engage the limit switch 18 as well as the stop lever 19 when the cam 11 rotates. A release strip 29 is formed integrally the first release plate 26 and engages with a manual pawl 10 for causing the manual pawl 10 to disengage from the ratchet gear 5 when the cam 11 rotates to a predetermined position.

A pin 26*a* of the first release plate 26 engages an elongate hole 30*a* provided on one end of a second release plate 30 which is swingably supported on the frame 3 by means of a pivot pin 31. The other end of the second release plate 30 engages the electrically powered pawl 25 for causing the pawl 25 to disengage from the ratchet gear 5 when the cam 11 rotates to the predetermined position.

The operation of the preferred embodiment will now be described as follows.

Figure 2:
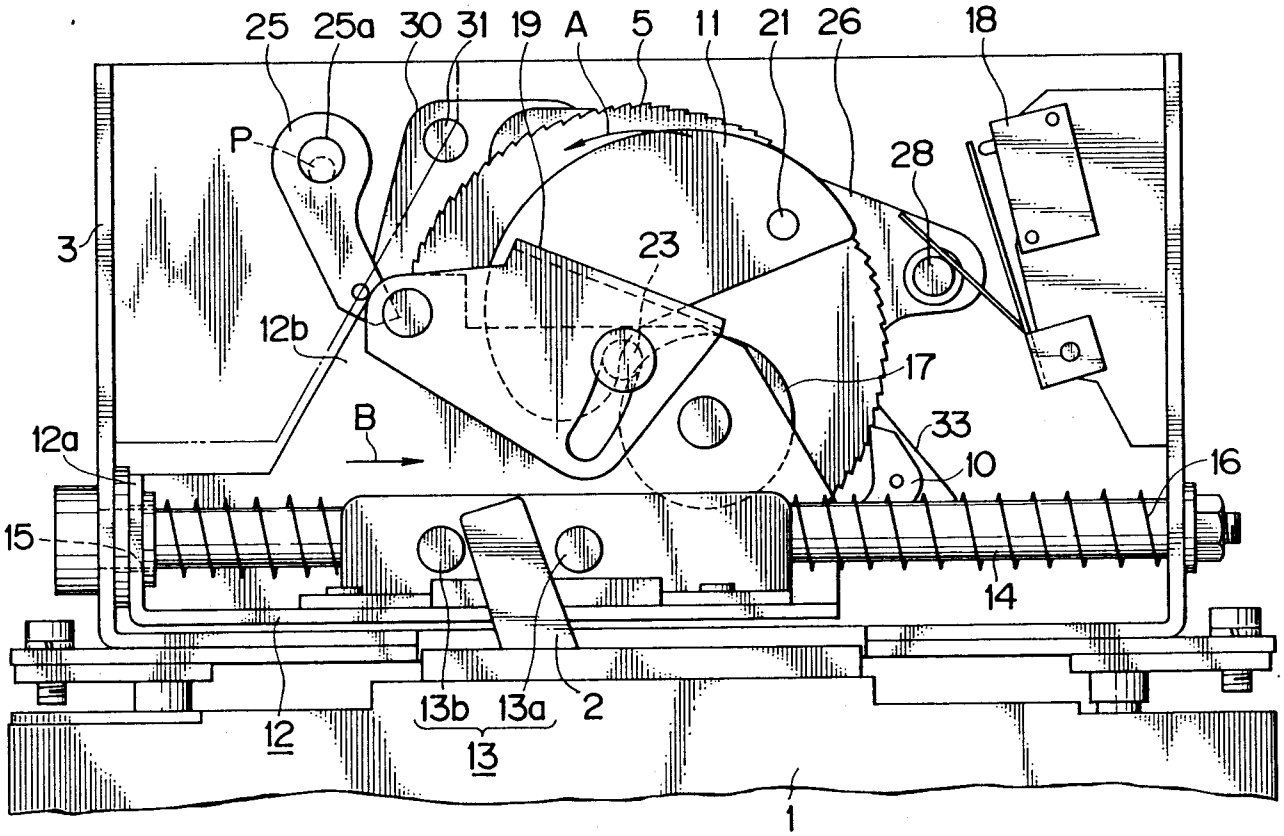
FIG. 2 is a cross sectional view taken along the line II—II of FIG. 1.
Figure 3:
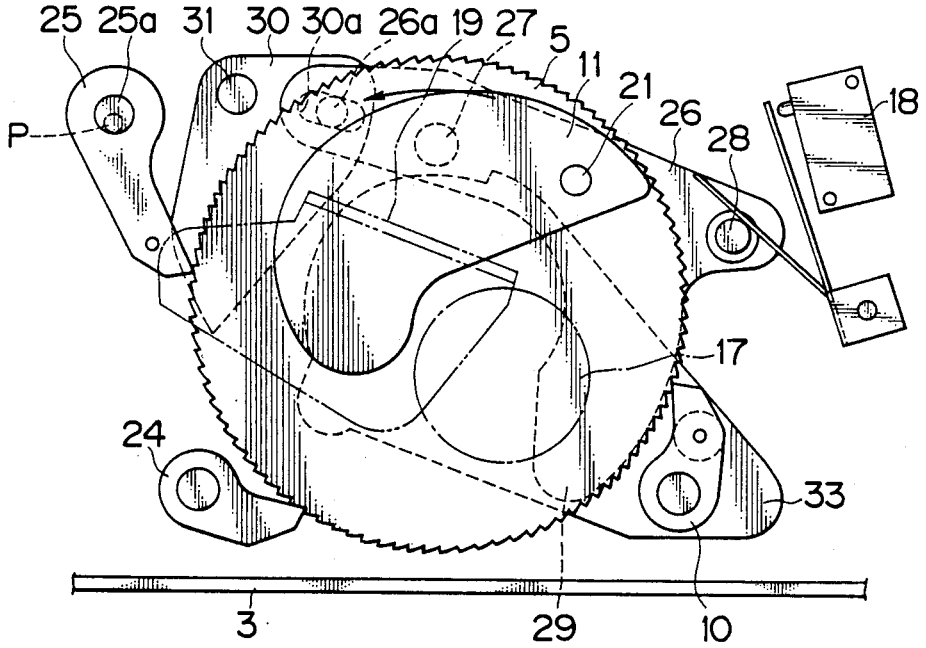
FIG. 3 is a cross sectional view in part taken along the line III—III of FIG. 1.
Figure 4:
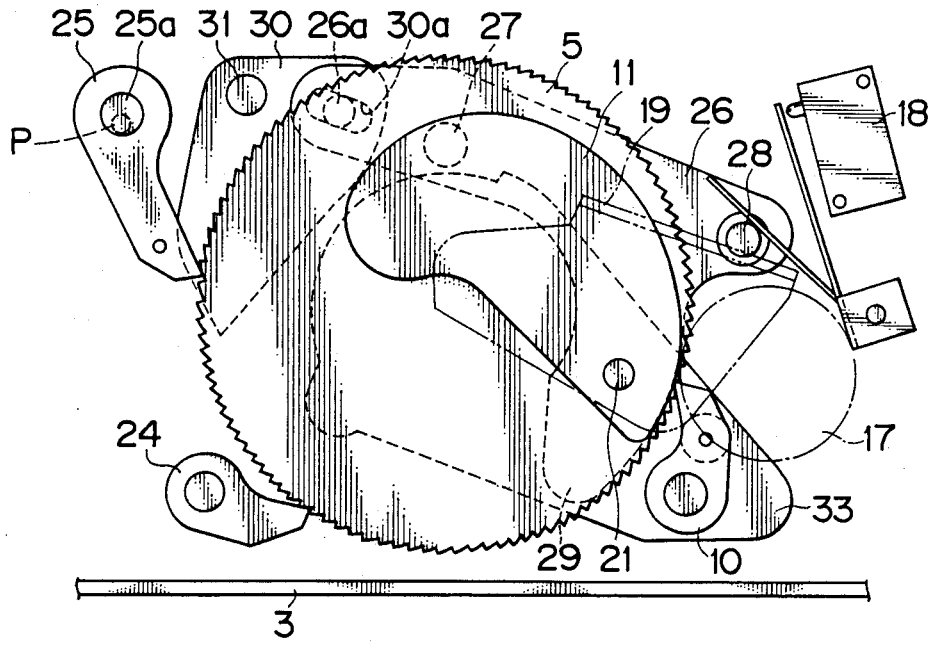
FIG. 4 is a diagram similar to FIG. 3 for illustrating a structural cooperation of the apparatus according to the invention while a spring is being compressed.
Figure 5:
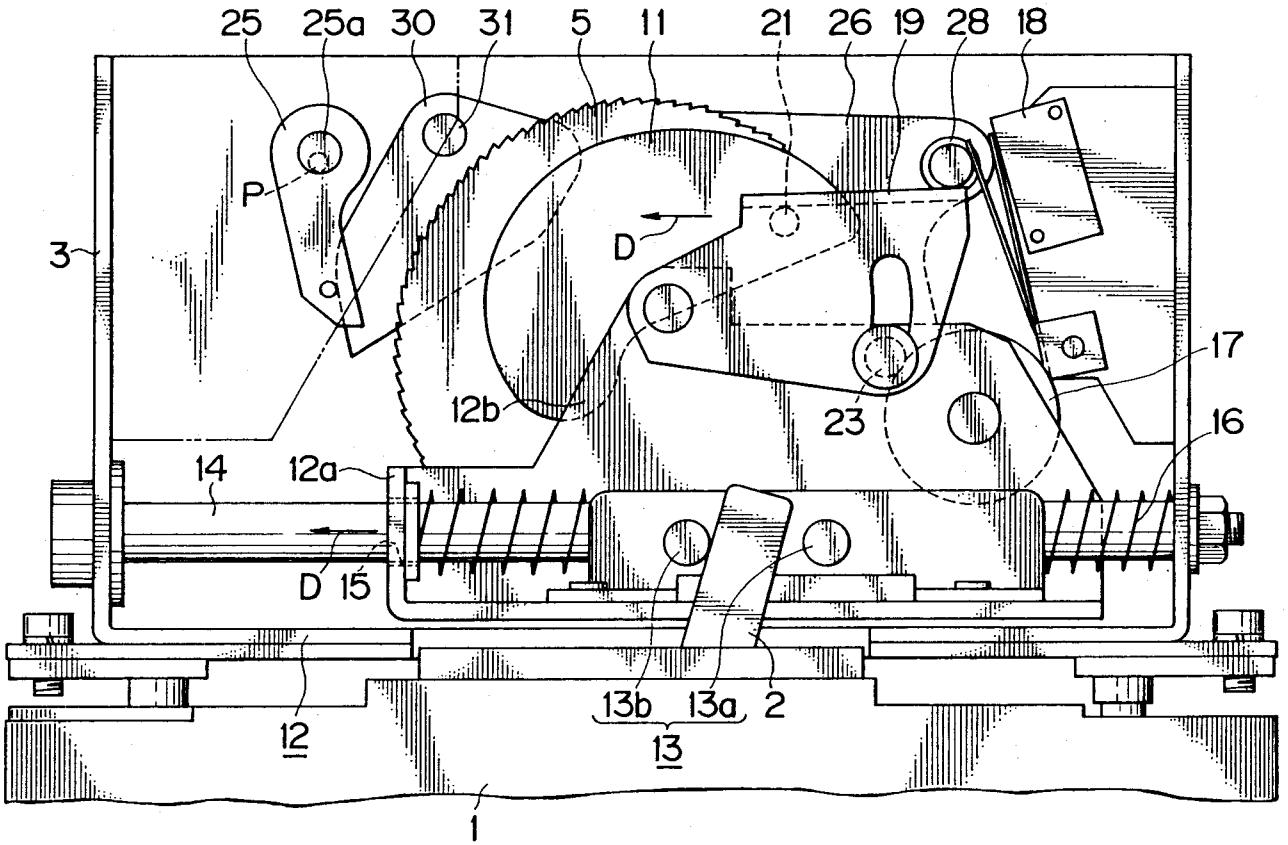
FIG. 5 is a diagram for illustrating the spring when it has been fully compressed.
Figure 6:
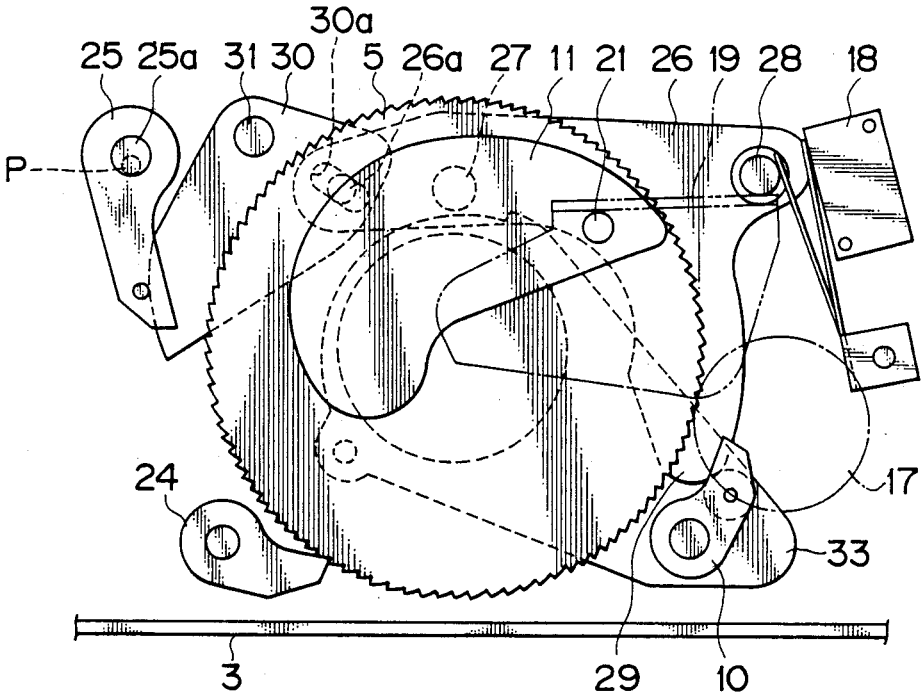
FIG. 6 is a diagram similar to FIG. 5 for illustrating structural cooperation of the apparatus according to the invention when the spring has been compressed fully.
Figure 7:
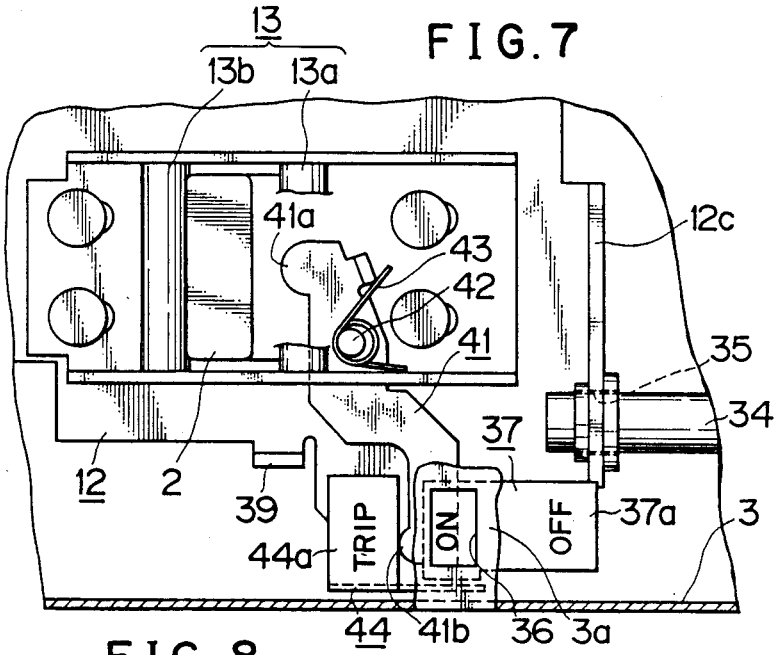
FIG. 7 is a detailed partial top view of FIG. 1 for showing the ON state of the circuit breaker.
Figure 8:
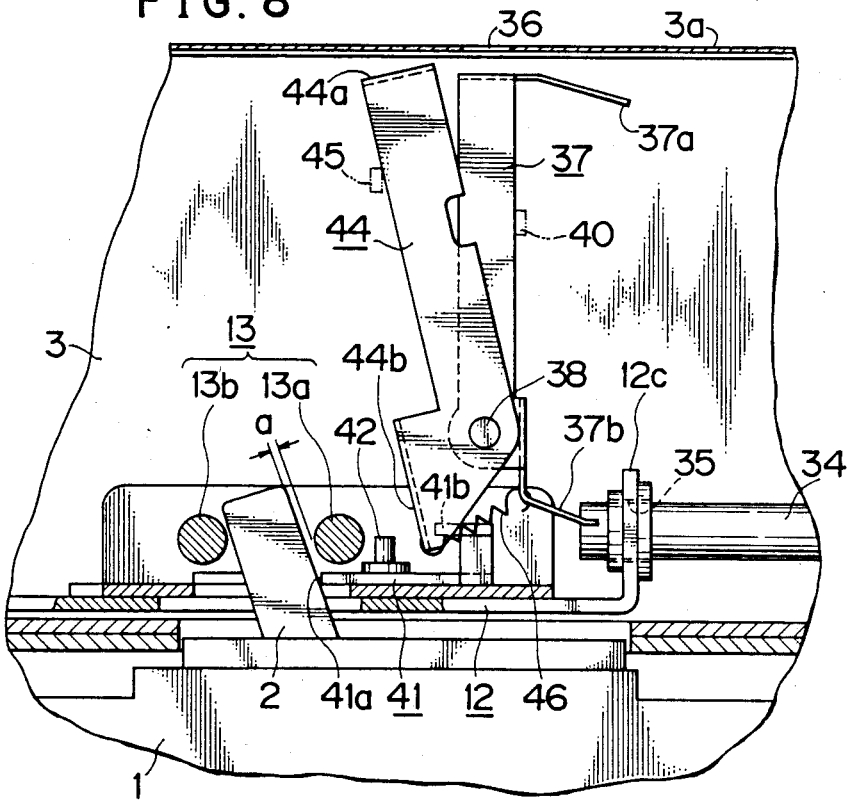
FIG. 8 is a cross sectional side view of FIG. 7.

FIG. 1 to FIG. 3 show the mechanical relation of the apparatus in the ON state of the circuit breaker 1. As is apparent from FIG. 8, there is a clearance a between the handle 2 and the ON handle-drive-pin 13*a*, and the protruding strip 39 is not in engagement with the lower portion 37*b* of the occurrence of ON/OFF display plate 37. Thus the ON/OFF display plate 37 and the trip display plate 44 are urged against the stoppers 40 and 45, respectively, by the tension spring 46 so that the indication, "ON", appears on the display window 36 located in wall 3*a* of the frame 3. The electric motor rotates upon occurrence of the ON signal for causing the electrically powered pawl 25 to perform an eccentric motion about the eccentric shaft 25*a*, which in turn drives the ratchet gear 5 in intermittent rotation in a direction A. The cam 11 rotates with the ratchet in the direction A to engage the roller 17, thereby causing the slider 12 to slide in a direction B. This causes the slider 12 to compress the spring 16 to store mechanical energy in the spring 16 while also throwing the handle into the OFF position by means of the OFF-drive-pin 13*b*. Then the stopper pin 21 of the cam 11 engages with the stop lever 19 for causing the stop lever 19 to swing to a position shown in FIG. 5. The stop lever 19 then engages with the release pin 28 which actuates the limit switch 18 to stop the electric motor 4, while at the same time the first release plate 26 pivots due to pivotal motion of the release pin 28 and causes the second release plate 30 to swing clockwise. Thus the second release plate 30 causes the electrically powered pawl 25 to move out of mesh engagement with the ratchet 5 while at the same time the release strip 29 causes the manual pawl 10 to move out of engagement with the ratchet 5. The spring 16 being compressed fully as shown in FIGS. 5 and 6, the circuit breaker 1 becomes OFF. With this OFF state, the protruding strip 39 engages with the lower portion 37*b* of the ON/OFF display plate 37 for causing the ON/OFF display plate 37 to swing counterclockwise against the tension spring 46.

In this manner, the limit switch 18 switches off the electric circuit of the motor 4 when the cam 11 rotates to the predetermined position while the electrically powered pawl 25 is set free from mechanical engagement with ratchet 5, thus the overrun of the cam 11 due to inertial energy of the electric motor 4 can be prevented. In FIG. 5 and FIG. 6 where the spring 16 is in fully compressed condition, the manual pawl 10 is also out of mechanical engagement with the ratchet 5. This permits an operator to determine whether the spring is compressed by manipulating a manual operating lever 33. If the operating lever 33 exhibits no mechanical resistance, the operator confirms that the spring 16 is certainly biased.

Figure 17A:
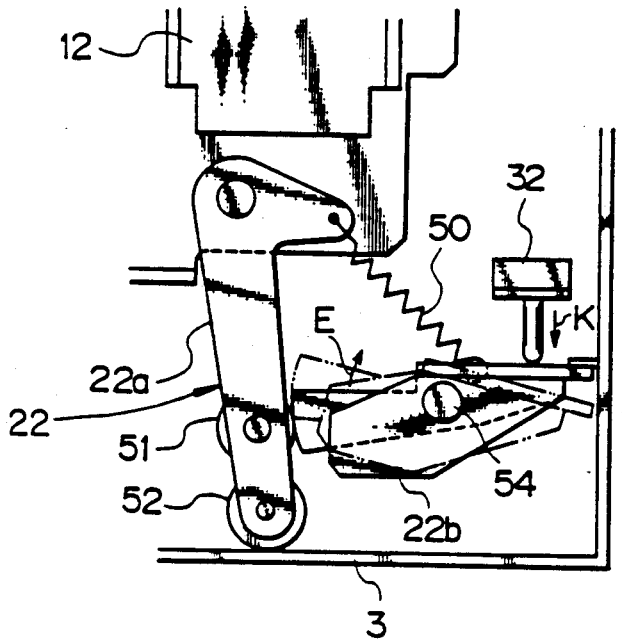
FIG. 17*a* shows a latch mechanism in the OFF state of the circuit.
Figure 17B:
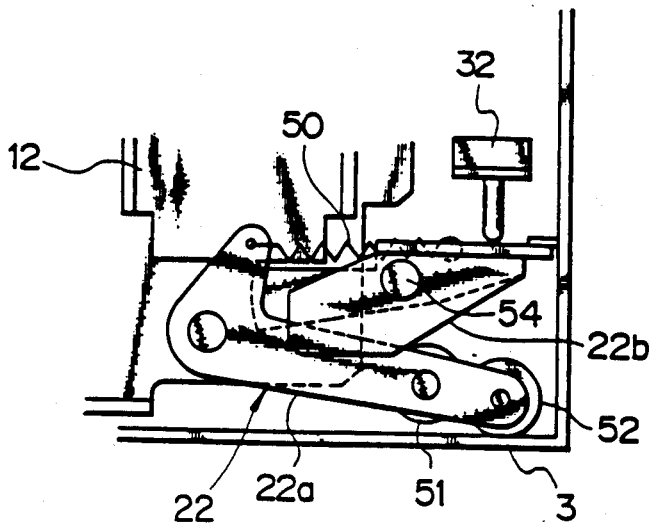
FIG. 17*b* shows a latch mechanism in the ON state of the breaker.

The slider 12 is latched by a latch mechanism 22 as shown in FIG. 17*a* and thus, the mechanical energy of the spring 16 is stored as shown in FIGS. 5 and 6. The latch mechanism 22 is to maintain both the slider 12 and the spring 16 at a position at which the spring 16 is urged fully and is formed of a link 22*a* of the slider 12 and a latch 22*b* on the frame 3 as shown in FIG. 17*a* and FIG. 17*b*. The link 22*a* includes a bearing member 51 upon which the latch 22 bears and a bearing member 52 which bears against the inner surface of the frame 3. A spring 50 tends to cause the latch 22*a* to rotate in the clockwise direction. FIG. 17*a* shows the latch mechanism 22 when the circuit breaker 1 is in OFF state.

The ON-operation of the circuit breaker 1 will now be described with reference to FIGS. 5 and 6.

The circuit breaker 1 is in the OFF state in FIGS. 5 and 6. When the solenoid 32 is energized upon an ON signal to kick the latch 22*b* in a direction of K, the latch 22*b* rotates, momentarily about pin 54, which supports the latch 22*b* rotatably on the frame 3 in a direction of E to thereby disabling the latching. FIG. 17*b* shows the latch mechanism 22 when the circuit breaker 1 is in ON state. Since the latch mechanism 22 sets the slider 12 free, the spring 16 discharges the stored mechanical energy thereof. Thus the slider 12 slides in a direction D in FIG. 5 while the stop lever 19 also moves in the direction D. During which the slider 12 throws the handle 2 of the circuit breaker into ON position by means of the ON-handle-drive-pin 13*a* as shown in FIG. 2. When the stop lever 19 moves in the direction D, the release pin 28 becomes out of engagement with the stop lever 19, thereby allowing the first release plate 26, the release strip 29, and the second release plate 30 to return to their initial positions as shown in FIG. 3, for example. Thus the electrically powered pawl 25 and the manual pawl 10 moves into mesh engagement with the ratchet gear 5 again as shown in FIG. 3 while at the same time the limit switch 18 is switched back to its initial state.

The trip display function of the invention will now be described as follows. With the ON state as shown in FIG. 1 to FIG. 3, FIG. 7, and FIG. 8, if the circuit breaker 1 trips, then the handle 2 travels the clearance a toward the ON-handle-drive-pin 13*a*. Thus the trip detecting plate 41 in contact with the handle 2 is caused to swing clockwise against the twist spring 43 by the motion of the handle 2, whereby the other end 41*b* of the trip detecting plate 41 contacts the trip display plate 44, causing the display plate 44 to swing clockwise about the pin 38. Consequently the display 44*a* of the trip display plate 44 takes up a position above the "ON" of the display 37*a* of the ON/OFF display 37 to display "TRIP" on the display window 36.

Figure 9:
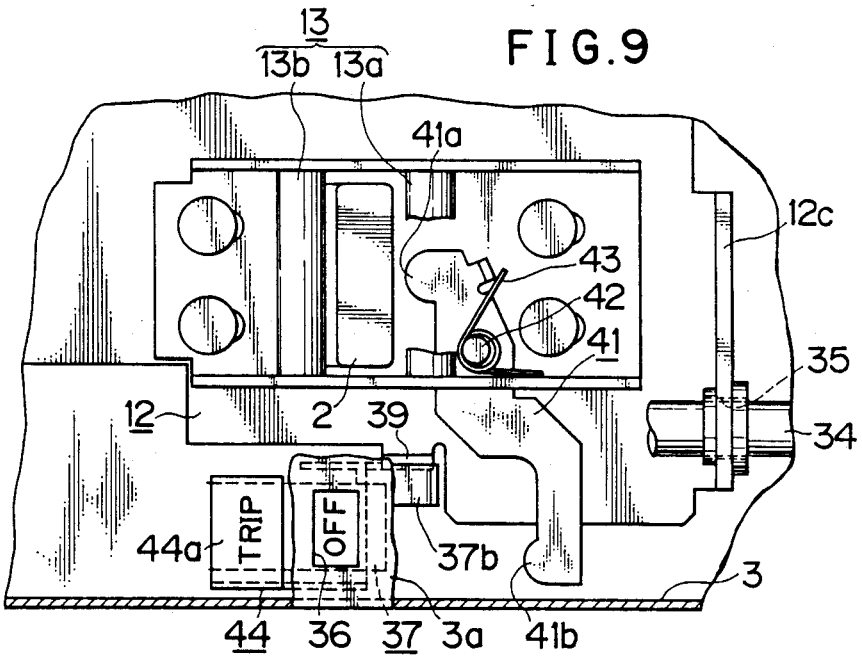
FIG. 9 is a diagram similar to FIG. 7 for showing the OFF state of the circuit breaker.
Figure 10:
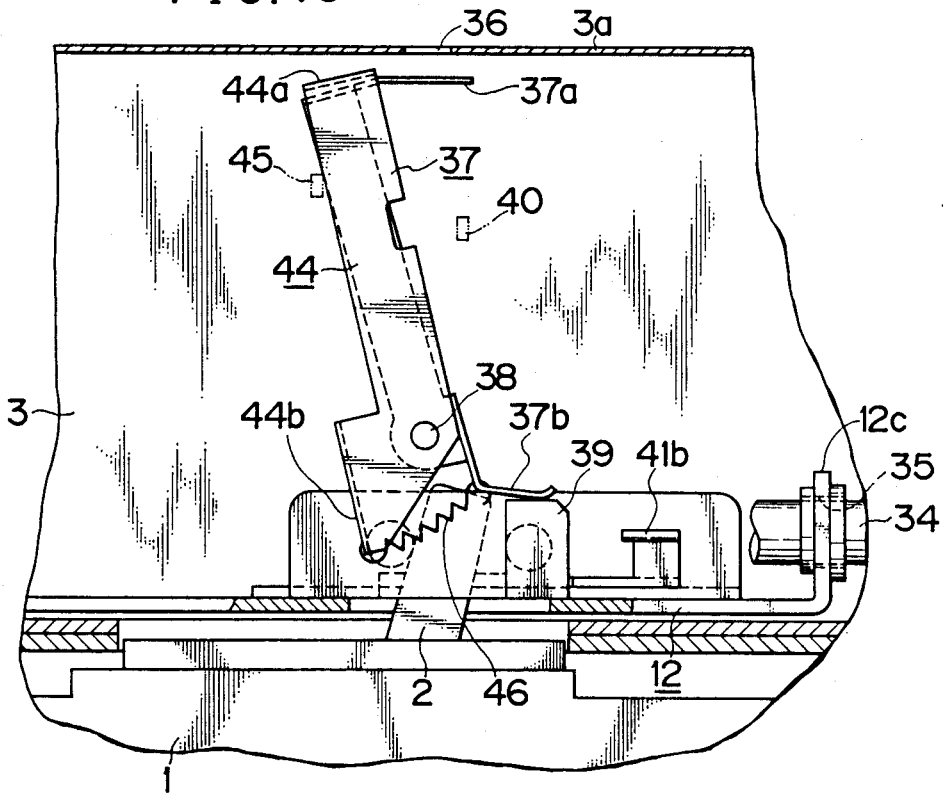
FIG. 10 is a cross sectional side view of FIG. 9.
Figure 11:
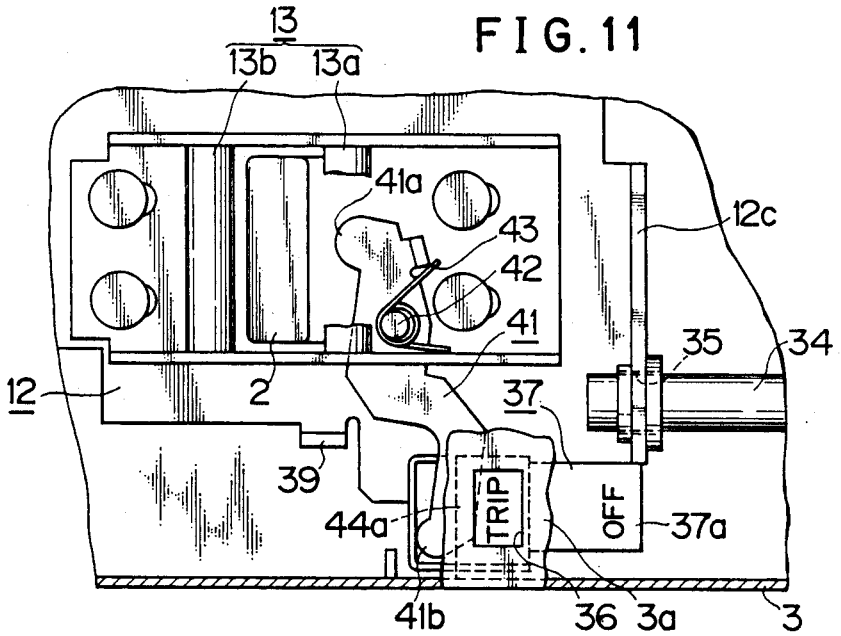
FIG. 11 is a diagram similar to FIG. 7 for showing the trip condition of the circuit breaker.
Figure 12:
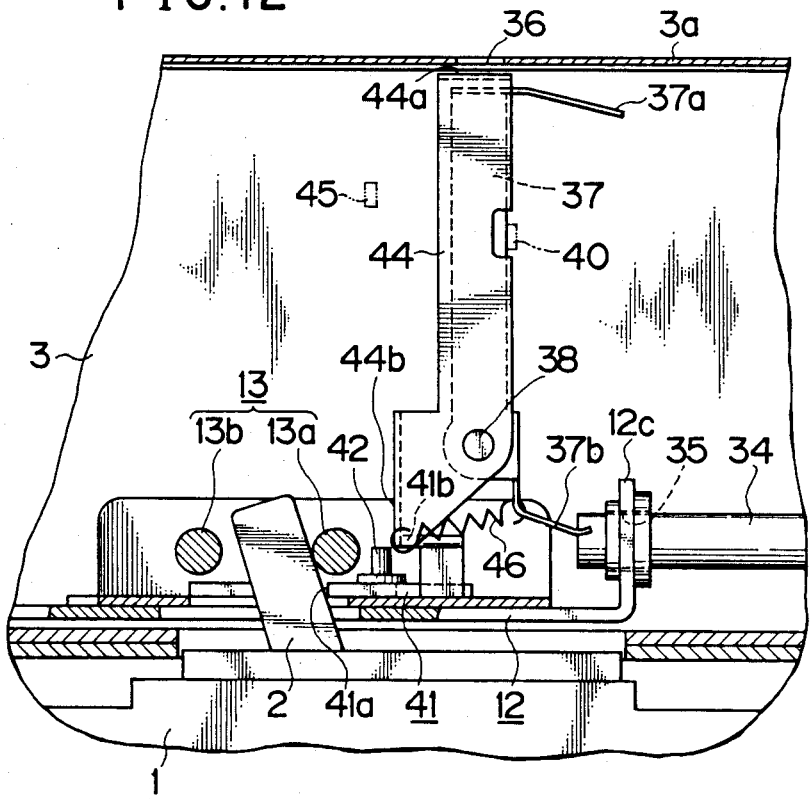
FIG. 12 is a cross sectional side view of FIG. 11.

Then if the operator operates the apparatus to reset, the slider 12 and the trip detecting plate 41 mounted rotatably on the slider 12 also slide in the direction B. Thus one end 44*b* of the trip display plate 44 is released from depressive engagement with one end 41*b* of the trip detecting plate 41 so that the trip display plate 44 swings counterclockwise with the aid of the spring 46 to return to the initial position thereof. Then display of the trip condition disappears. Similarly, one end 41*a* of the trip detecting plate 41 is also released from depressive engagement with the handle 2 so that the trip detecting plate 41 rotates counterclockwise with the aid of the spring 43 to return to the initial position thereof. The slider 12 further slides for depressing one end 37*b* of the ON/OFF display plate 37 at the protruding strip 39 to drive the ON/OFF display plate 37 in counterclockwise rotation. Thereafter the OFF-handle-drive pin 13*b* completes the reset operation of the circuit breaker 1 as shown in FIG. 9 and FIG. 10.

Combining the trip detecting plate 41 with the trip display plate 44 can amplify a small clearance, a, of the handle 2 to produce a large movement of the display "TRIP", which permits an operator to certainly recognize the clear trip display, thereby reducing chances of misoperation of the breaker handle.

What is claimed:

1. An apparatus for electrically operating a circuit breaker, said circuit breaker including a handle positioned in a first position when said circuit breaker assumes an OFF state and positioned in a second position when said circuit breaker assumes an ON state, said apparatus comprising:

a frame mounted on the circuit breaker;

a slider slidably supported on said frame, said slider engaging the handle of the circuit breaker for throwing the circuit breaker into the OFF state by sliding the handle to the first position, and throwing the circuit breaker into the ON state by sliding the handle back to the second position; and trip display means for displaying a trip condition of the circuit breaker when the circuit breaker shifts from the ON state to the OFF state thereof in response to an overcurrent condition, said trip display means being pivotally supported on the frame and being pivotally movable from a non-display position when the handle is not tripped to a display position upon trip of the handle for displaying indicia that is indicative of the trip condition of the circuit breaker.

2. An apparatus for electrically operating a circuit breaker according to claim 1, wherein said apparatus further comprises a display window for displaying the trip condition of the circuit breaker and wherein said trip display means includes a substantially elongate trip detecting plate which is supported pivotally at an intermediate point thereof on said slider and which engages at one tip end thereof with the handle of the circuit breaker to pivot when the handle trips, and a substantially elongate trip display plate having indicia indicative of said trip condition of the circuit breaker on one end thereof, said trip display plate being pivotally supported at an intermediate point thereof on said frame and engaging said trip detecting plate at an other end thereof, said trip display plate being caused by said trip detecting plate to pivot to said display position where said indicia appears in said display window during trip of the handle when the circuit breaker is switched from said ON state to said OFF state.

3. An apparatus for electrically operating a circuit breaker according to claim 2, wherein said apparatus further comprises:

a substantially elongate ON/OFF display plate having an indicia on one end thereof for displaying ON state and OFF state of the circuit breaker, said elongate ON/OFF display plate being swingably supported at an intermediate point thereof on said frame, said ON/OFF display plate engaging at the other end thereof with said slider for swinging to a first position to display ON-state of the breaker when the slider moves to the ON position of the breaker, and to a second position to display OFF-state of the breaker when the slider moves to the OFF position of the breaker; and a tension spring mounted between said ON/OFF display plate and said trip display plate for urging one toward the other, said ON/OFF display plate being caused to swing against said tension spring to display said OFF-state, and said trip display plate being caused to swing against said tension spring to display the trip condition of the circuit breaker.

4. An apparatus for electrically operating a circuit breaker, said circuit breaker including a handle positioned in a first position when the circuit breaker assumes an OFF state and positioned in a second position when the circuit breaker assumes an ON state, said apparatus comprising:

a frame mounted on the circuit breaker;

a slider slidably mounted on the frame and slidably movable with respect to said handle, said slider engaging and sliding the handle to the first position for throwing the circuit breaker into the OFF state, and engaging and sliding the handle to the second position for throwing the circuit breaker into the ON state;

a trip detecting member pivotally supported on the slider, said trip detecting member having one end located adjacent said handle and having an other end; and a trip display member pivotally supported on the frame, said trip display member having a display portion with indicia indicative of a trip condition of the circuit breaker thereon and having a lower portion located adjacent said other end of the trip detecting member so that when the circuit breaker trips, the handle will engage the one end of the trip detecting member to cause the trip detecting member to pivot such that the other end of the trip detecting member contacts the lower portion of the trip display member thereby resulting in pivotal movement of the trip display member in order to display said indicia.

* * * * *